United States Patent [19]

Endo et al.

[11] Patent Number: 4,958,426

[45] Date of Patent: Sep. 25, 1990

[54] FUSE TERMINAL MANUFACTURING METHOD

[75] Inventors: Takayoshi Endo; Yuuji Hatagishi, both of Shizuoka, Japan

[73] Assignee: Yazaki Corporation, Japan

[21] Appl. No.: 424,610

[22] Filed: Oct. 20, 1989

Related U.S. Application Data

[62] Division of Ser. No. 238,470, Aug. 31, 1988, abandoned.

[30] Foreign Application Priority Data

Sep. 1, 1987 [JP] Japan ..... 62-216298

[51] Int. Cl.[5] ..... H01H 69/02

[52] U.S. Cl. ..... 29/623; 29/411; 29/445; 228/240; 219/121.12

[58] Field of Search ..... 29/623, 411, 412, 445; 337/160, 163, 296; 228/240; 219/121.12

[56] References Cited

U.S. PATENT DOCUMENTS

| | | | |
|---|---|---|---|
| 2,781,434 | 2/1957 | Swain | 337/296 |
| 2,864,917 | 12/1958 | Sundt | 337/296 |
| 4,308,514 | 12/1981 | Kozacka | 337/159 |

FOREIGN PATENT DOCUMENTS

| | | | |
|---|---|---|---|
| 235429 | 10/1960 | Australia | 337/160 |
| 59-66844 | 5/1984 | Japan . | |

*Primary Examiner*—P. W. Echols

*Attorney, Agent, or Firm*—Wigman & Cohen

[57] ABSTRACT

To obtain a stable adhesion between a fused portion of a fuse terminal and a low fusing point metal, the low fusing point metal is clad or welded by an electron beam to the fused portion of the fuse terminal. To manufacture the fuse terminal at low cost, the low fusing point metal is first clad or welded to the middle portion of a fusible conductor sheet material; the sheet material is punched into a development shape of the fuse terminal with the low fusing point material located at the fused portion; the punched sheet metal is bent into a fuse terminal shape before cut away from the sheet material.

3 Claims, 3 Drawing Sheets

FUSE TERMINAL MANUFACTURING METHOD

RELATED APPLICATION

This application is a divisional application of U.S. patent application Ser. No. 238,470, filed Aug. 31, 1988, now abandoned.

BACKGROUND OF THE INVENTION

1. Field of the Invention

The present invention relates to a fuse terminal and its manufacturing method and more specifically to a fuse terminal provided with a low fusing point metal at the fused portion thereof.

2. Description of the Prior Art

The same applicant has already proposed a fuse terminal provided with a low fusing point metal at a fused portion of the fuse terminal in Japanese Published Unexamined (Kokai) Utility Model Appli. No. 59-66844. In this application, a recessed seat is formed at the middle portion of a fused portion made of a metal having a large thermal deformation such as bimetal (Ni and Cu); a low fusing point metal piece such as tin ($S_n$) or lead ($P_b$) is fitted to the recessed seat; and this low fusing point metal piece is held to the fused portion by bending tabs formed extending from both the side ends of the fused portion around the low fusing point metal piece.

In this prior-art fuse terminal, it is possible to improve the fusing characteristics on the basis of alloy formed due to diffusion of low fusing point metal into the fusible material of the fused portion; that is, it is possible to reduce the lower limit of fusion at the low current range, while preventing the fuse from being melted away by an instantaneous excessive current.

In the prior-art fuse terminal as described above, however, there exists a problem in that the fusing characteristics are not stable. This is because (1) since the low fusing point metal piece is fitted into a recess formed in the fused portion and held thereto by only use of bent tabs, the low fusing point metal piece is not stably brought into tight contact with the fusible material (dispersion in adhesion between the low fusing point metal and the fusible material); and (2) since the low fusing point metal piece (e.g. $S_n$, $P_b$, etc.) of rod shape is soft and therefore deformable, it is difficult to form the rod-shaped metal piece accurately into a predetermined length (dispersion in dimensions of the low fusing point metal).

In addition, since it is necessary to form a recessed seat on the surface of the fused portion in order to hold the low fusing point metal piece to the fuse terminal, the number of manufacturing steps increases, thus resulting in an increase in the manufacturing cost.

SUMMARY OF THE INVENTION

With these problems in mind, therefore, it is the primary object of the present invention to provide a fuse terminal and its manufacturing method, which is stable in fusing characteristics and low in manufacturing cost.

To achieve the above-mentioned object, a method of manufacturing a fuse terminal formed with a pair of opposing contact portions and a fused portion connected between the opposing contact portions, according to the present invention, comprises the steps of: (a) fixing low fusing point metal material at a middle portion of a fusible conductor sheet material along a longitudinal direction thereof; (b) punching the fusible conductor sheet material provided with the low fusing point metal material into a development shape of the fuse terminal in such a way that the low fusing point material is located at the fused portion of the fuse terminal; and (c) bending the punched fusible conductor sheet material into a fuse terminal shape; and (d) cutting off the punched and bent fusible conductor from the sheet material.

Further, it is also possible to manufacture a fuse terminal by (a) fixing low fusing point metal material at the middle portion of a fusible conductor sheet material along a longitudinal direction thereof; (b) punching the fusible conductor sheet material into a fused portion shape in such away that the low fusing point material is located at a middle portion of the fused portion; (c) forming a pair of opposing contact portions, separately from the fused portion; and (d) fixing said punched fused portion provided with the low fusing point metal material to the opposing contact portions by welding.

BRIEF DESCRIPTION OF THE DRAWINGS

The features and advantages of the fuse terminal of the present invention will be more clearly appreciated from the following description of the preferred embodiment of the invention taken in conjunction with the accompanying drawings, in which like reference numerals designate the same or similar elements or sections throughout the figures thereof and in which:

FIGS. 3A, 3B and 3C are perspective views showing a cartridge fuse including a fuse terminal according to the present invention, in which FIG. 3A shows a fuse housing lid; FIG. 3B shows a fuse terminal; and FIG. 3C shows a fuse housing; and FIG. 4A, 4B, and 4C are perspective views showing another cartridge fuse including another modification of the fuse terminal according to the present invention, in which FIG. 4A shows a fuse housing lid; FIG. 4B shows a fused portion; FIG. 4C shows a pair of two opposing contact portions.

DETAILED DESCRIPTION OF THE PREFERRED EMBODIMENTS

Embodiments of the fuse terminal of the present invention will be described with reference to the attached drawings.

Figure 1:
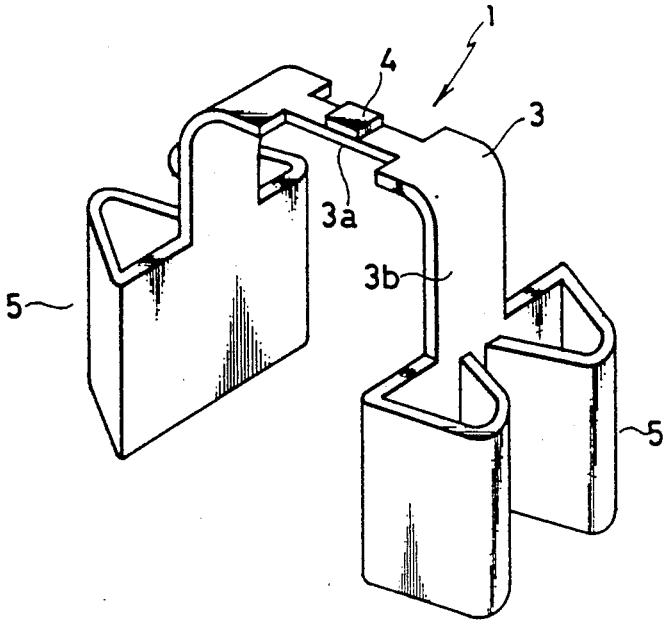
FIG. 1 is a perspective view showing an embodiment of a fuse terminal according to the present invention.

FIG. 1 shows an embodiment of the fuse terminal 1 of the present invention, which comprises a pair of two opposing triangular prism-shaped female contact portions 5, an arched stay portion 3 formed with a fused portion 3a and two opposing straight portions 3b, and a low fusing point metal piece 4 mounted on the middle portion of the fused portion 3a. This low fusing point metal piece 4 is tin ($S_n$), lead ($P_b$), etc. This metal piece 4 is fixed to the fused portion 3a by means of an appropriate method such as cladding or electron beam welding, etc.

To manufacture the fuse terminal 1, a thin copper alloy sheet material 6 is punched to form a development shape of the fuse terminal 1; the development shaped sheet material is bent to form the two triangular prism shaped contact portions 5 (to each of which a tab-shaped male terminal is inserted) and the arched stay portion 3; and the low fusing point metal piece 4 is fixed to the fused portion 3*a* of the arched stay portion 3, as shown in FIG. 1.

However, it is more preferable to previously fix the metal piece 4 to the sheet material. In this case, the fuse terminal 1 is manufactured by punching, bending, and cutting a conductive sheet material on which a low fusing point metal material is cladded or welded by an electron beam, as described in further detail hereinafter.

Here, cladding implies that two kinds of metal are brought into tight contact with each other by applying pressure between the two metals.

Where the low fusing point metal 4 is fixed as described above, it is possible to reduce the dispersion in adhesion between the metal 4 and the fusible material of the fused portion 3*a*. Further, since it is unnecessary to form a recess in the fused portion 3*a*, the manufacturing process can be simplified. In addition, when the fuse terminal 1 is manufactured by machining a clad material on which low fusing point metal pieces 4 are clad or a material on which low fusing point metal pieces 4 are welded by an electron beam, it is possible to reduce the dispersion in the volume of a low fusing point metal piece 4.

After two male terminals (not shown) are inserted into the two opposing contact portions 5 formed on both the sides of the female terminal 1, current is passed through the female terminal 1. In this case, the low fusing point metal piece 4 functions as follows: when an excessive current momentarily flows through the female terminal 1, although heat is concentrically generated at the fused portion 3*a*, since the low fusing point metal 4 of high conductivity effectively absorbs heat, it is possible to prevent the fused portion 3*a* from being melted away by an instantaneous excessive current passed therethrough. Further, at the junction point between the fused portion 3*a* and the low fusing point metal piece 4, since both the metals of the fused portion 3*a* and the low fusible point metal piece 4 are mutually diffused into an alloy, the volume resistivity at the fused portion 3*a* increases (calorific power per unit time increases), thus allowing the fusible portion 3*a* to be easily fused at the low current region.

Figure 2:
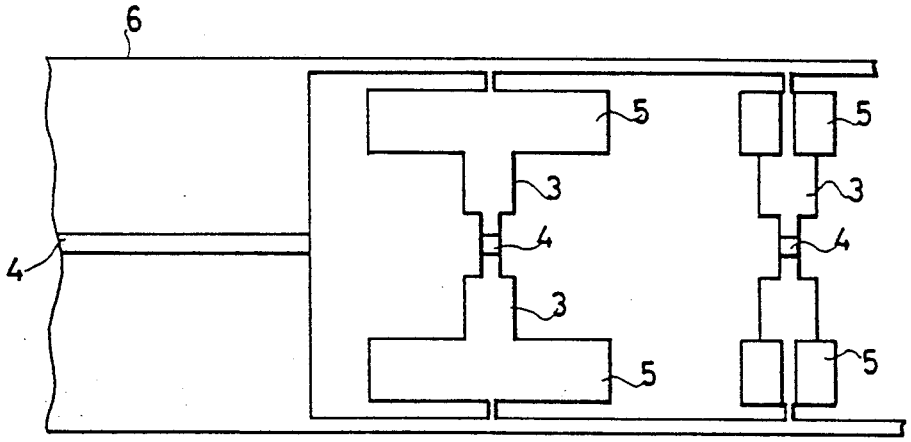
FIG. 2 is a view for assistance in explaining the manufacturing steps of the fuse terminal according to the present invention.

The method of manufacturing the fuse terminal of the present invention will be described is more detail with reference to FIG. 2.

The material used for forming fuse terminals 1 is 0.4 mm thick copper alloy sheet metal 6, on which a 3 mm-wide and 50 μ-thick low fusing point metal 4 made of tin ($S_n$) or lead ($P_b$) is clad or welded by an electron beam at the middle portion of the sheet metal 6 along the longitudinal direction thereof. The sheet metal 6 provided with the low fusing point metal 4 is punched into a development shape of a fuse terminal 1 in such a way that the low fusing point metal 4 is located at the fused portion 3*a* (at the middle of the fuse terminal 1). Thereafter, the punched material piece is bent into a fuse terminal 1 as shown in FIG. 1 and then cut off from the sheet material 6. Since the fuse terminals 1 are manufactured through only punching and bending process, it is possible to markedly reduce the manufacturing steps as compared with the conventional manufacturing method, because no recess is required to be formed in the fused portion 3*a*.

Further, when the used (punched) sheet metal 6 is required to be used again, it is possible to easily separate the low fusing point metal 4 from the sheet metal 6 because of a big difference in melting point between the two.

Figure 3A:
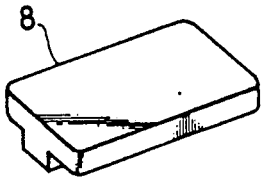
Figure 3B:
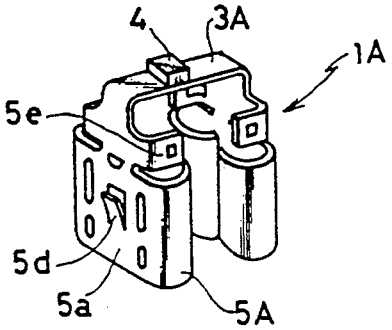
Figure 3C:
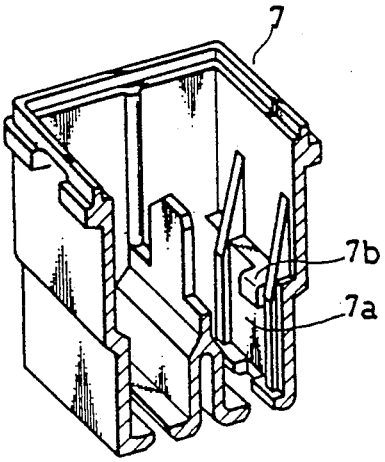
Figure 4A:
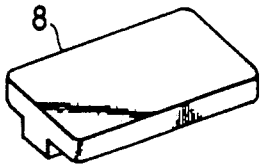
Figure 4B:
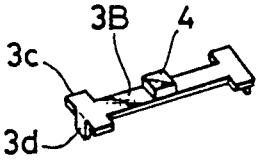
Figure 4C:
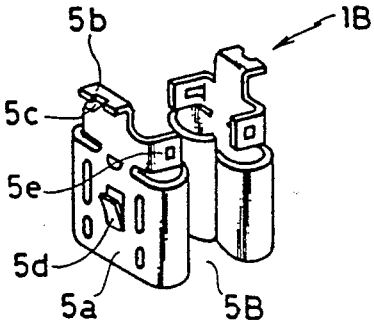
Figure 4D:
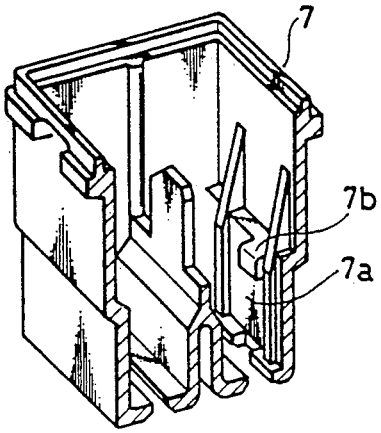
FIG. 4D shows a fuse housing.

FIGS. 3A, 3B and 3C show a first modification of the fuse terminal 1 housed within a fuse housing 7 as a cartridge fuse. In this modification, the fuse terminal 1 is formed with four side bent portions 5*e* over the contact portions 5A and two lance portions 5*d* at the flat side surfaces 5*a* of the contact portions 5A.

Further, the fuse housing 7 is formed with two inner walls 7*a* and the two projection walls 7*b*. Therefore, when the fuse terminal 1A is inserted into the fuse housing 7, the lance portions 5*d* are engaged with the projection walls 7*b* with the flat side surface 5*a* of the contact portions 5A in contact with the inner wall 7*a* of the fuse housing 7, thus preventing the fuse terminal 1 from being removed from the fuse housing 7. Further, the four side bent portions 5*e* serve to locate the fuse terminal 1A stably within the fuse housing 7. Further, in FIG. 3A, the numeral 8 denotes a transparent lid 8, through which the fused portion can be seen well from the outside.

In the above embodiment, the fused portion 3A is formed integral with the female contact portions 5A. However, it is also possible to form the fused portion separately from the female contact portions. In this case, a low fusing point metal 4 is clad or welded by an electron beam at the middle portion of the material for the fused portion along the longitudinal direction thereof. This sheet metal provided with the low fusing point metal 4 is punched into the shape of the fused portion. The punched fused portion is fixed by welding to the contact portions, as described in more detail later.

In this modification, it is preferable to form the fused portion by a material different from that of the contact portions. For instance, when the fused portion is made of a material of large thermal deformation, it is possible to melt the fused portion further quickly at the low current range, because of the synergistic effect of the thermal deformation and an increase in the volume resistivity at the fused portion due to the alloy formed by the fused portion and the low fusing point metal 4.

In more detail, with reference to FIGS. 4A to 4D which show a second modification of the fuse terminal 1B housed within the fuse housing 7, the fused portion 3B is separated from the two opposing contact portions 5B. That is, a low fusing point metal piece 4 is fixed to the middle portion of the fused portion 3B by cladding or electron beam welding. The fused portion 3B is formed with two wide spot welding portions 3*c* extending from both the ends of the fused portion 3B and two bent tab portions 3*d*, respectively. Further, the contact portion 5B is formed with a flat seat portion 5*b* and a cut-out portion 5*c* in addition to the side bent portion 5*e* and the lance portion 5*d*. Therefore, a fuse terminal 1B can be formed by fitting the two bent tab portions 3*d* to the cut-out portion 5*c* for location and by spot welding both the portions 3*c* and 5*b*. The other explanation is the same as the first modification shown in FIGS. 3A to 3C.

As described above, in the fuse terminal according to the present invention, since a low fusing point metal is fixed to the fused portion of the fuse terminal by cladding or electron beam welding, it is possible to reduce the dispersion in adhesive characteristics between the low fusing point metal and the fusible material of the fused portion, thus resulting in stable fusion characteristics.

Further, since no recess for receiving the low fusing point metal is required to be formed, it is possible to simplify the manufacturing steps, thus reducing the manufacturing cost.

Further, in the method of manufacturing the fuse terminal of the present invention, since a material on which a low fusing point metal is previously fixed by cladding or electron beam welding is punched into the developed shape of a fuse terminal in such a way that the low fusing point metal is located at the fused portion of the fuse terminal and bent into the fuse terminal shape, it is possible to reduce the dispersion in the adhesion between the low fusing point metal and the fusible material of the fused portion and the quantity of the low fusing point metal, thus realizing stable fusing characteristics and reducing the manufacturing steps and therefore the cost of the fuse terminal.

What is claimed is:

1. A method of manufacturing a fuse terminal formed with a pair of opposing contact portions and a fused portion connected between the opposing contact portions, which comprises the steps of:

(a) fixing low fusing point metal material at a middle portion of a fusible conductor sheet material along a longitudinal direction thereof;

(b) punching the fusible conductor sheet material provided with the low fusing point metal material into a development shape of the fuse terminal in such a way that the low fusing point material is located at the fused portion of the fuse terminal;

(c) bending the punched fusible conductor sheet material into a fuse terminal shape; and (d) cutting off the punched and bent fusible conductor from the sheet material.

2. The method of claim 1, wherein said low fusing point metal is fixed to said fused portion by cladding.

3. The method of claim 1, wherein said low fusing point metal is fixed to said fused portion by welding.

* * * * *